US005453738A

United States Patent [19]

Zirkl et al.

[11] Patent Number: 5,453,738

[45] Date of Patent: Sep. 26, 1995

[54] REMOTE-CONTROL SYSTEM FOR LARGE ROOMS WITH FREE GROUPING

[75] Inventors: Siegmar Zirkl, Regensburg; Horst Gerlach, Neutraubling, both of Germany

[73] Assignee: Siemens Aktiengesellschaft, Munich, Germany

[21] Appl. No.: 763,664

[22] Filed: Sep. 18, 1991

[30] Foreign Application Priority Data

Sep. 27, 1990 [EP] European Pat. Off. ..... 90118606

[51] Int. Cl.[6] ..... G08C 17/00

[52] U.S. Cl. ..... 340/825.52; 340/825.69; 340/825.72; 340/310.01; 359/142; 307/40

[58] Field of Search ..... 340/825.52, 825.07, 340/825.04, 825.24, 825.69, 825.72, 310 R, 310 CP, 310.01, 310.08; 359/142; 307/38, 40, 115

[56] References Cited

U.S. PATENT DOCUMENTS

| | | | |
|---|---|---|---|
| 4,173,754 | 11/1979 | Feiker | 340/310 R |
| 4,352,992 | 10/1982 | Buennagel et al. | 307/40 |
| 4,467,314 | 8/1984 | Weikel et al. | 340/310 CP |
| 4,885,569 | 12/1989 | Lellouche | 340/825.04 |
| 5,008,662 | 4/1991 | Tokizane et al. | 359/142 |
| 5,132,679 | 7/1992 | Kubo et al. | 340/825.24 |
| 5,160,924 | 11/1992 | Jean-Pierre et al. | 340/825.52 |

FOREIGN PATENT DOCUMENTS

| | | | |
|---|---|---|---|
| 0348726 | 3/1990 | European Pat. Off. . | |
| 3119876 | 12/1982 | Germany . | |
| 3407389 | 8/1985 | Germany . | |
| 3803920 | 8/1989 | Germany . | |
| 2183377 | 6/1987 | United Kingdom | 340/825.69 |
| WO91/10276 | 7/1991 | WIPO | 307/40 |

*Primary Examiner*—Brent Swarthout
*Assistant Examiner*—A. M. Hill
*Attorney, Agent, or Firm*—Kenyon & Kenyon

[57] ABSTRACT

A remote-control system permits user definable grouping of transmitters, which send wireless messages encoded with transmitted key addresses, and of receiving decoders, which are coupled via a bus to a plurality of actuators. The decoders each include a corresponding programmable storage device which can be programmably occupied as an association table, and assign in a freely definable manner assigned key addresses, which are oriented according to transmitter command keys, to each transmitted key address. Each assigned key address designates a particular actuator so that desired groups of actuators may be controlled with a single message.

12 Claims, 5 Drawing Sheets

REMOTE-CONTROL SYSTEM FOR LARGE ROOMS WITH FREE GROUPING

BACKGROUND OF THE INVENTION

U.S. patent application Ser. No. 07/762,553 entitled "Remote-Control System for Large Rooms Having a Reception Range Assigned to Each Receiver" and U.S. patent application Ser. No. 07/762,845 "Remote-Control System for Large Rooms Having Multiple Decoders Coupled by a Bus" were filed on even date herewith and assigned to the same assignee. The disclosures in these applications are hereby incorporated by reference.

The present invention relates generally to remote-control systems, and more particularly to a remote-control system which permits grouping of transmitters that send wireless messages, and which permits grouping of receiving decoders, which preferably control actuators.

German Patent document No. DE-A-3 803 920 discloses assigning specific transmitting commands in the decoder to specific outputs through programming. The known decoder is set up to learn information words from a given transmission format and, after that, to recognize them again. Infrared signalling is used as the transmitting medium between the transmitter and the decoder.

In building systems engineering, one often needs to selectively trigger various actuators with a single transmitter command, whereby the actuators control devices that are connected at any one time. In addition to lights, such devices can be motors for window shutters or diverse apparatus and devices used in building systems engineering. Also, in particular, one often needs to trigger several actuators with a single transmitter command, so that a grouping results.

The present invention is directed to the problem of developing a remote-control system for large rooms with free grouping.

SUMMARY OF THE INVENTION

The present invention solves this problem by means of storage devices, which are programmed as an association table, through which the decoders permit one or more key addresses to be assigned to each received key address. This association table is freely definable and is located on the output of the actuators. The received key address is oriented according to command keys.

According to the selection that is made, when the transmitter sends a key address, one or more of the decoder's outgoing sections can receive it. The association table constitutes a sort of matrix between the outputs of the transmitter and the outputs of the decoder.

Another development consists in that the key addresses, both of the transmitters and also on the output sides of the decoders, work with base addresses. These base addresses, with respect to transmitters and decoders, correlate according to an ordering principle, which results in a specific allocation through the selection of an ordering element. Various transmitters can act thereby on different kinds of outgoing sections by using the same key addresses in the same decoder. Organizing base addresses and key addresses in this way gives one complete freedom in assigning command signals from diverse transmitters to diverse decoder outputs.

It is therefore possible to install devices, and then later on to set up command lines for operating the system and the devices from the individual transmitters. Manually operated components on the transmitter units can be operated in this case in the same way as customary installation switches and regulating units. Many different types of manually operated components are consolidated here under the term "keys". The important thing is the command output that is acquired and its processing.

It is favorable for the key addresses on the output side of the association table to be assigned in each case according to the place value of the bits to the output whose ordinal number corresponds to the place value. In this manner, the allocation can be carried out simply.

The base addresses can be advantageously set on each transmitter, for example by means of a binary coding switch. The setting at the decoder can follow accordingly or be determined by the message.

A straightforward allocation of transmitters to devices or consumers is furthered, when the key address that is addressed on the input side of the decoder is displayed by a pointer.

DETAILED DESCRIPTION

Figure 1:
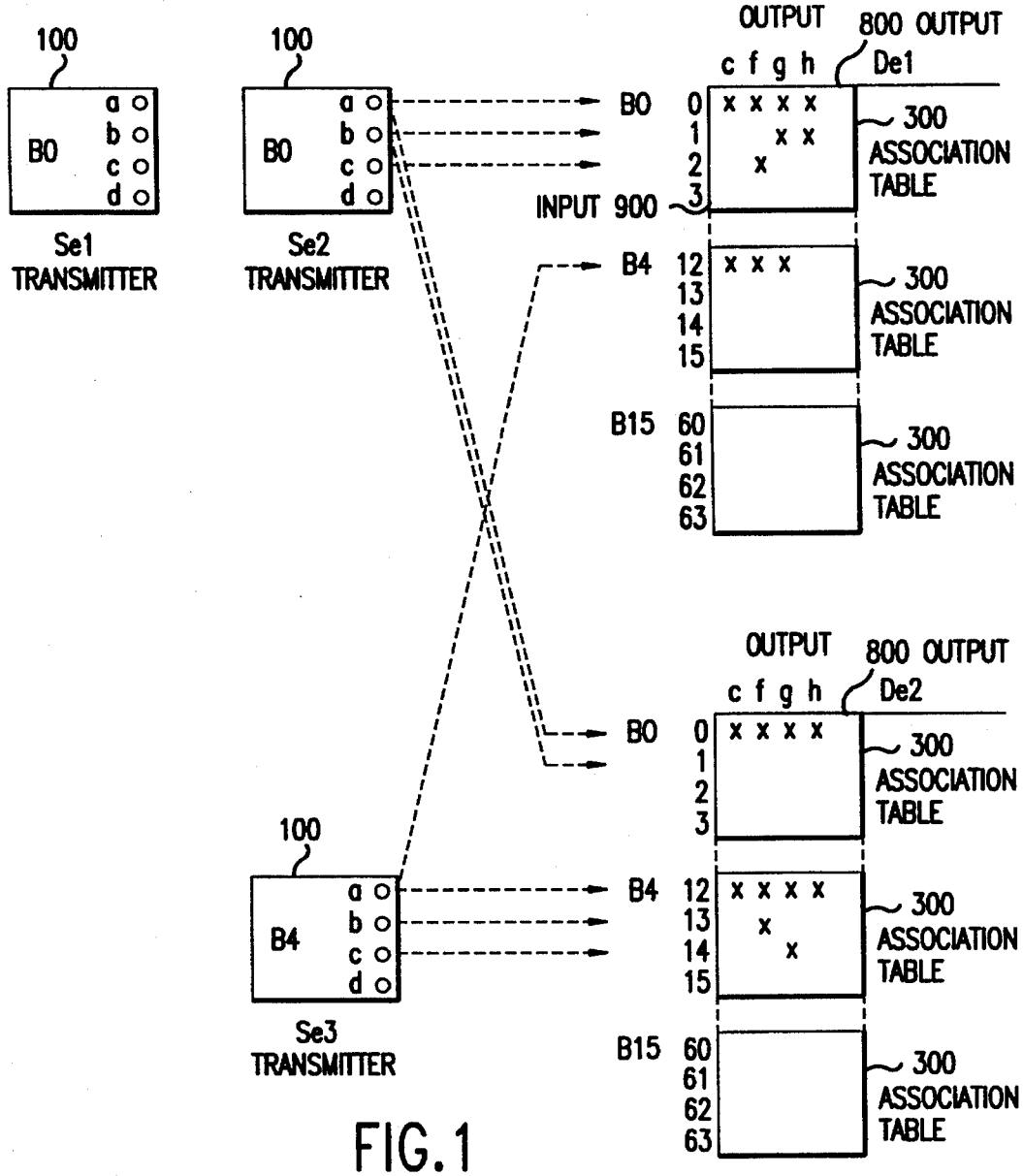
FIG. 1 illustrates the interaction of messages from the transmitters with the association tables of the decoders and the occupancy of the decoder outputs.

The remote-control system works with transmitters 100, Se1, Se2 and Se3, and with decoders 200. One can compare the association tables 300 of FIG. 1. Infrared light is particularly suited as a transmitting medium for the messages emitted by the transmitters 100, since when provided with appropriate coding, it is not easily susceptible to interference. The infrared signal is emitted by the actual transmitter 400 and received by a receiver 500 according to FIG. 2. The decoders 200, De1, De2, are connected to actuators 600, preferably via a bus 601. While decoders 200 are connected to actuators 600 via bus 601 in FIG. 2, any other connection (such as, for example, discrete circuit wiring) may be used between decoders 200 and actuators 600 according to the present invention. By way of the decoders 200 and their association table 300, predetermined actuators 600 receive the messages output by the transmitter 100. For their part, the predetermined actuators 600 actuate or control installation equipment. In addition to lights, such installation equipment can include many different kinds of devices used in building systems engineering and installation engineering, for example servo-motors, as well as controlling and regulating devices, such as heating systems or burglar-alarm systems. These types of systems can be switched on and off, as well as armed and disabled by the remote-control system.

The decoders 200 have storage devices, which are programmed as association tables 300. One or more key addresses on the output side 800 of the association tables 300 relative to the actuators 600 are able to be assigned by means of the association tables and in a freely definable manner to each received key address of a message, whereby the received key address corresponds to command keys 700.

The transmission of a key address by the transmitter 100 can be received by one out of four outgoing sections 800, "e,f,g,h" as selected, or by several outgoing sections. Thus, in FIG. 1, the outputs "e,f,g,h" are assigned to the incoming side 900 of the association table 300 of the decoder 200 with the identification "De1", and to the input "0" on the output side 800. A key address "a" supplied by the transmitter 100 with the identification "Se2" is received by the outputs "e,f,g,h" in the decoder "De1", as illustrated by the crosses. A decoder 200 designated as "De1" with the association table 300 works with 16 base addresses "BO–B15". In the exemplified embodiment according to FIG. 1, the transmitter 100 designated as "Se2" acts in the case of the decoder 200 designated as "De1" in the base address "BO" upon the inputs "0, 1 and 2", and upon the outputs on the output side 800 with the identifications "e,f,g,h", as well as in the decoder with the identification "De 2"in the base address "BO" upon the inputs "0" and "1". The storage device is not occupied at the input 1, so that none of the four outputs in the example has a relationship with the input 1.

The transmitter 100 designated as "Se3" acts with its key address "a" in the decoder "De1" in the base address "B4" upon the input 12 and the outputs "e,f,g", as well as in the decoder "De 2" in the base address "B4" upon the input "12" and the outputs "e,f,g,h". The key addresses b and c are received by the inputs "13 and 14" and the outputs "f" or "g", respectively. The transmitter 100 designated as "Se1" is to be understood programmably as a double, that is its individual key assignment and its function conform with those of the transmitter "Se2".

Figure 2:
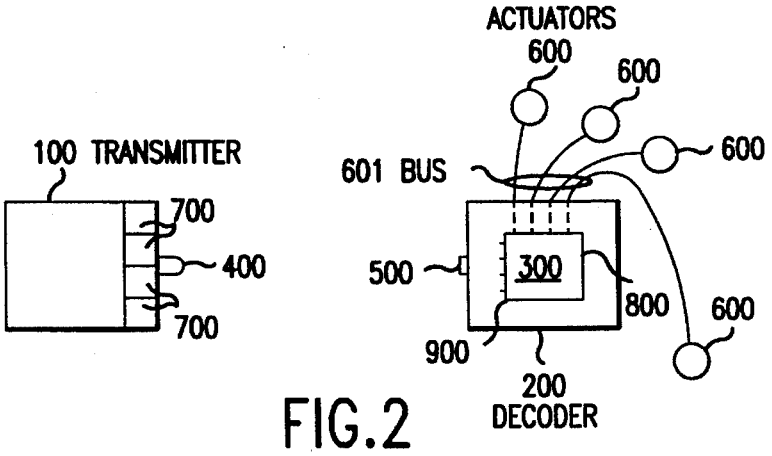
FIG. 2 schematically depicts a transmitter and a decoder with an association table, which is connected by circuit wiring to actuators.

In the exemplified embodiment according to FIG. 1, according to the selection made, one or more outgoing sections of the decoders are assigned to receive the transmission of a key address by a transmitter. At the same time, various transmitters with the same key addresses can act upon diverse outgoing sections in the same decoder. As a comparison, one can consider the key address "a" in the transmitter 100 designated as "Se2" and the transmitter "Se3" with the key address "a".

Based on the place value of the bits, in each case the outgoing section, whose ordinal number corresponds to the place value, can be assigned in the association tables on the output side. The base addresses can be set on every transmitter, for example by means of a binary coding switch. The key address that is addressed on the input side can be advantageously displayed by a pointer on the decoder 200. In this connection, one also speaks of indirect addressing.

It is clear that the remote-control system renders possible a free grouping, for example an internal grouping relative to a transmitter, in that namely several outputs of the decoder, as well as groupings which encompass several decoders, receive a key address. In the case of a four-channel system, therefore four keys of a transmitter unit, and sixteen base addresses, as provided by commercial units, one obtains an address space of 4×16=64. A long-term storage device, for example an EEPROM, is particularly suited for the association table.

The programming can proceed as follows: by dividing all necessary control outputs for a specific application by the number of channels, that is four channels in the exemplified embodiment, one obtains the number of required decoders. The number of single functions plus group functions of control outputs yields the total number of keys, which divided by the number of channels yields the minimum number of transmitters. When doubles are desired, the required number of transmitters increases. The transmitters allocate and adjust the base addresses in turn, that is continually. The decoder outputs can be randomly connected up to consumers or to their actuators. It is practical for all of the decoders to have a programming key to get into the learning mode, or else the learning mode can also be initiated by a special message from the transmitter. Each transmitter advantageously has a special key then, for example a so-called ball-point-pen key, which can be operated by the tip of a pen, to deliver messages in order to initiate the learning mode. A lesser energy output is sufficient for these types of messages. One must ensure that no external remote-control signals are emitted in the room during the programming.

The functional sequence of the programming can unfold in particular, for example, in accordance with FIG. 1, as follows: In a first step, the programming key for the learning mode is depressed on the appropriate decoder. In a second step, the key of the transmitter to be programmed in the association table of the decoder is depressed, for example key "c" key c of transmitter "Se2", which causes an entry to be made on the input side 900 of the decoder "De1" under "f". A pointer on the decoder can display the addressed input. Manipulating the key "c" once more by depressing it three times causes the output "f" to be assigned in the association table. This procedure can be repeated three times to leave open those blank locations which should not be occupied. As a result, the four instances of acceptance readiness are used up for the input line. If further outputs have to be assigned, the digits corresponding to the outputs can be occupied by manipulating the keys accordingly. Instead of the description "pointer", in data processing one also speaks of "indirect addressing". Therefore, here the intention is not that one has to visualize a pointer.

Understandably, other methods, which are customarily applied in data processing, are also possible.

In a third step, one can check which output is occupied by quickly depressing the key on the transmitter. This is advantageous in cases where the consumers had already been connected up at random, and the allocation of the installation is undertaken later. In a fourth step, by depressing the key for a longer time, all four outputs can be assigned, so that one allocates all four outputs as a group to this one key address.

In a fifth step, the programming key for the decoder's learning mode is depressed once again, or in the case of a device with special messages, it is sent by the transmitter, so that the decoder returns to the normal mode. After that, the working operation of the installation is possible.

Figure 3:
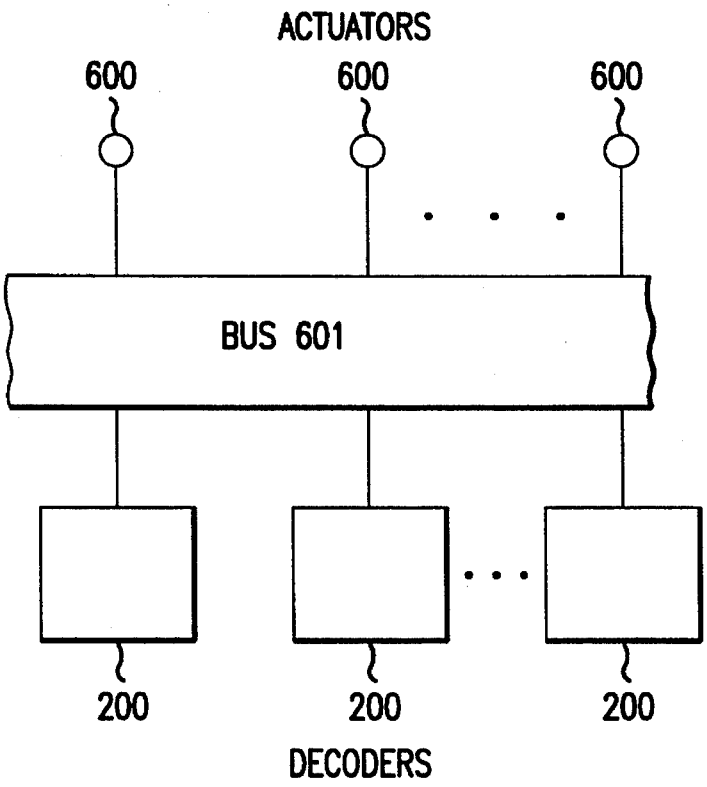
FIG. 3 illustrates a bus connection between a plurality of decoders and a plurality of actuators.
Figure 4:
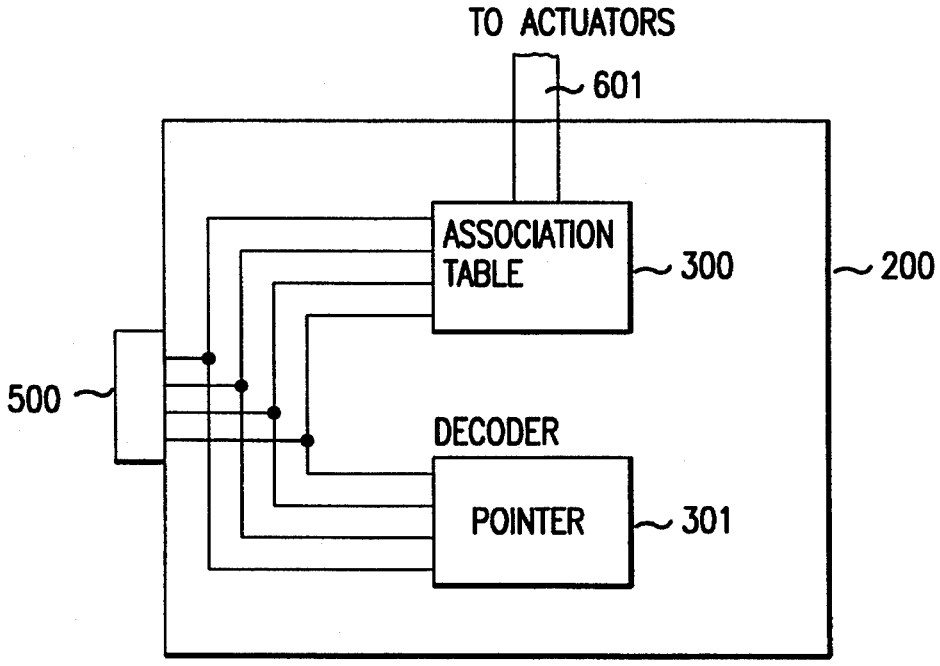
FIG. 4 illustrates a decoder including an association table and a pointer.

FIG. 3 illustrates a bus 601 connected between a plurality of decoders 200 and a plurality of actuators 600. FIG. 4 illustrates a decoder 200 including an association table 300 and a pointer 301.

Figure 5:
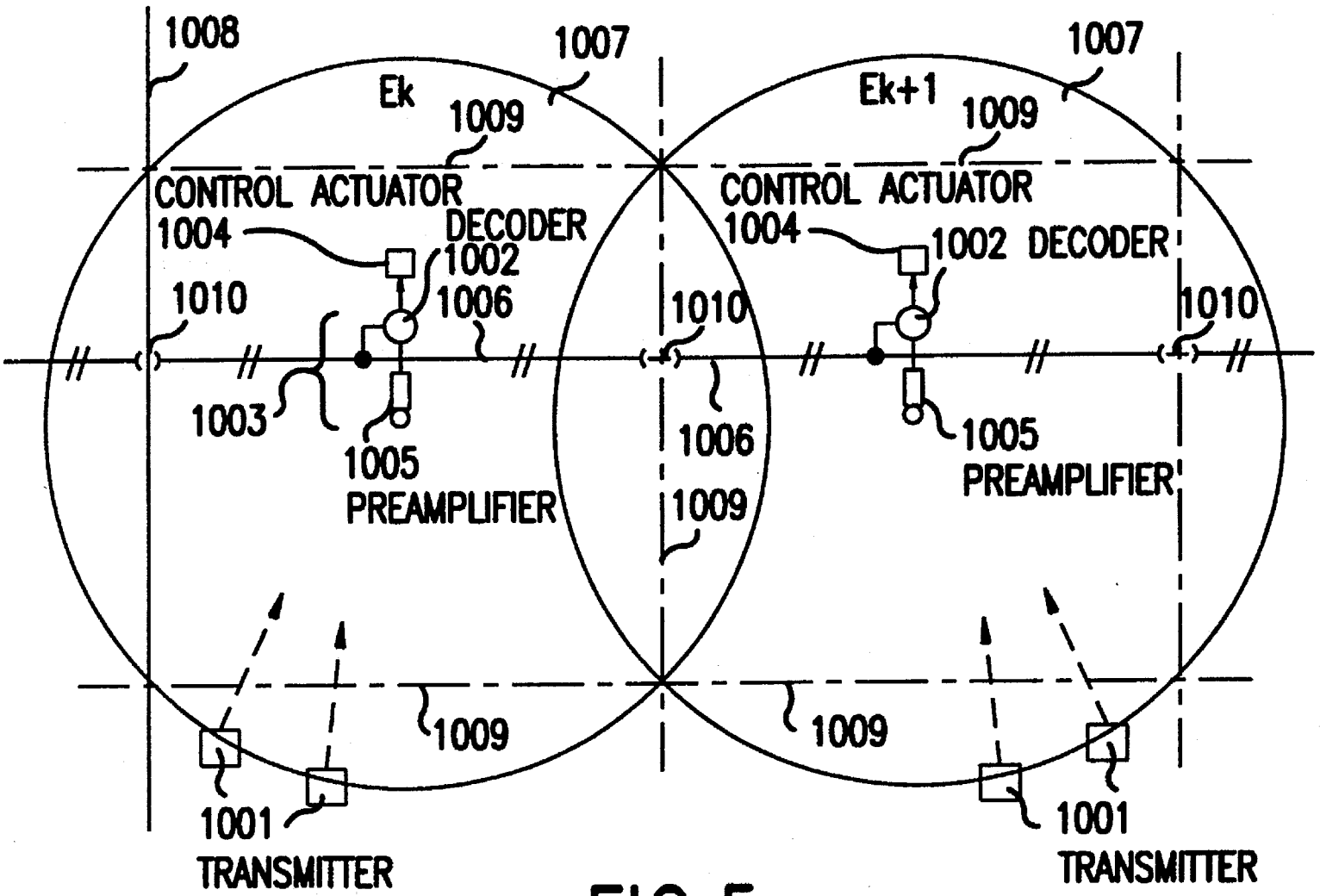
FIG. 5 illustrates a remote control system in which decoders are interconnected via a bus according to an embodiment of the present invention.

Decoders may be used according to an embodiment of the present invention such as the embodiment illustrated in FIG. 5. The decoders may be interconnected by a bus, which decoders use collision detection while accessing this bus, and by coding the "ON", "OFF" circuit states in the messages. The entire incoming address, or even a translated address, is transmitted to the interconnected decoder from the specific decoder, which is activated by a valid message. In addition, the active circuit state for the power circuitry is transmitted by the active decoder. Independently of the existing circuit state, the message that is received confirms or requests a specific circuit state, so that it is not possible for the actuators and the associated installation equipment to lose synchronization. Other actuators associated with additional line-connected decoders are controlled simultaneously as a result of the forced synchronization. When a message is recognized by more than one decoder, collision detection prevents a single message from causing more than one decoder to access the bus, which would be disturbing. Thus, when there are two detecting decoders, only the faster decoder transmits to the bus.

The remote-control system illustrated in FIG. 5 works with transmitters 1001 and decoders 1002 in receivers 1003. The decoders 1002 or the receivers 1003 control actuators 1004 or switching elements. In the simplest cast, the actuators 1004 are connected to the receivers 1003 via a bus. The receivers 1003 essentially consist of a preamplifier 1005 for the message received through the transmitting medium, for example infrared light. The decoders 1002 are interconnected by means of a bus 1006. Each decoder has a reception range 1007, in which it can receive messages from transmitters 1001. Of the reception ranges 1007, the reception range Ek and the reception range Ek+1 are depicted in the exemplified embodiment of FIG. 5. These reception ranges 1007 are part of a remote-control system for a large room which has a wall 1008 and organizational room axes 1009. Sensors can also be linked to the interconnected decoders. These sensors can be advantageously designed as triggers and, as desired, at every change in the switch position, transmit an "ON" or "OFF" via the connecting line to the address previously set at the sensor. Actuators on decoders, which are programmed to this address, are then definitely switched.

To be able to lengthen or shorten the line quite easily, it is advantageous to apply isolating points 1010, which can be favorably arranged along organizational room axes. These isolating points can be designed in all sorts of ways, as generally known, when they guarantee the operation of connectors.

The isolating points can also be realized by means of software, by assigning various addresses to the various corresponding room areas. Room-encompassing overlapping functions can be realized by selecting some of the same addresses for several room areas. These same addresses then permit room-encompassing functions for the appropriate room areas.

Since the decoders 1002 are interconnected by a bus 1006, the decoders 1002 access the bus 1006 using well-known collision detection techniques. Additionally, the "ON", "OFF" circuit states of the actuators 1004 are coded so that if some actuators fail to receive a command to change their circuit state, the circuit state of the actuators 1004 is then corrected on the next command. The entire incoming address, or even a translated address, is transmitted to the interconnected decoder 1002 from the specific decoder 1002, which is activated by a valid message. In addition, the active circuit state for the power circuitry is transmitted by the active decoder 1002. Independently of the existing circuit state, the message that is received confirms or requests a specific circuit state, so that it is not possible for the actuators and the associated installation equipment to lose synchronization. Other actuators associated with additional line-connected decoders are controlled simultaneously as a result of the forced synchronization. When a message is recognized by more than one decoder, collision detection prevents a single message from causing more than one decoder 1002 to access the bus 1006. Thus, when there are two detecting decoders 1002, only the faster decoder 1002 transmits to the bus 1006.

The connecting line can be a bus conductor or, depending on the application case, it can also be a single conductor with a ground return line. The bus can advantageously be designed so that it is capable of being separated or extended along organizational room axes by means of isolating points having the operating characteristics of plug-and-socket connectors. The remote-control system can then be easily adapted to organizational changes, newly added walls, or to the new conditions which exist when walls have to be removed.

Figure 6:
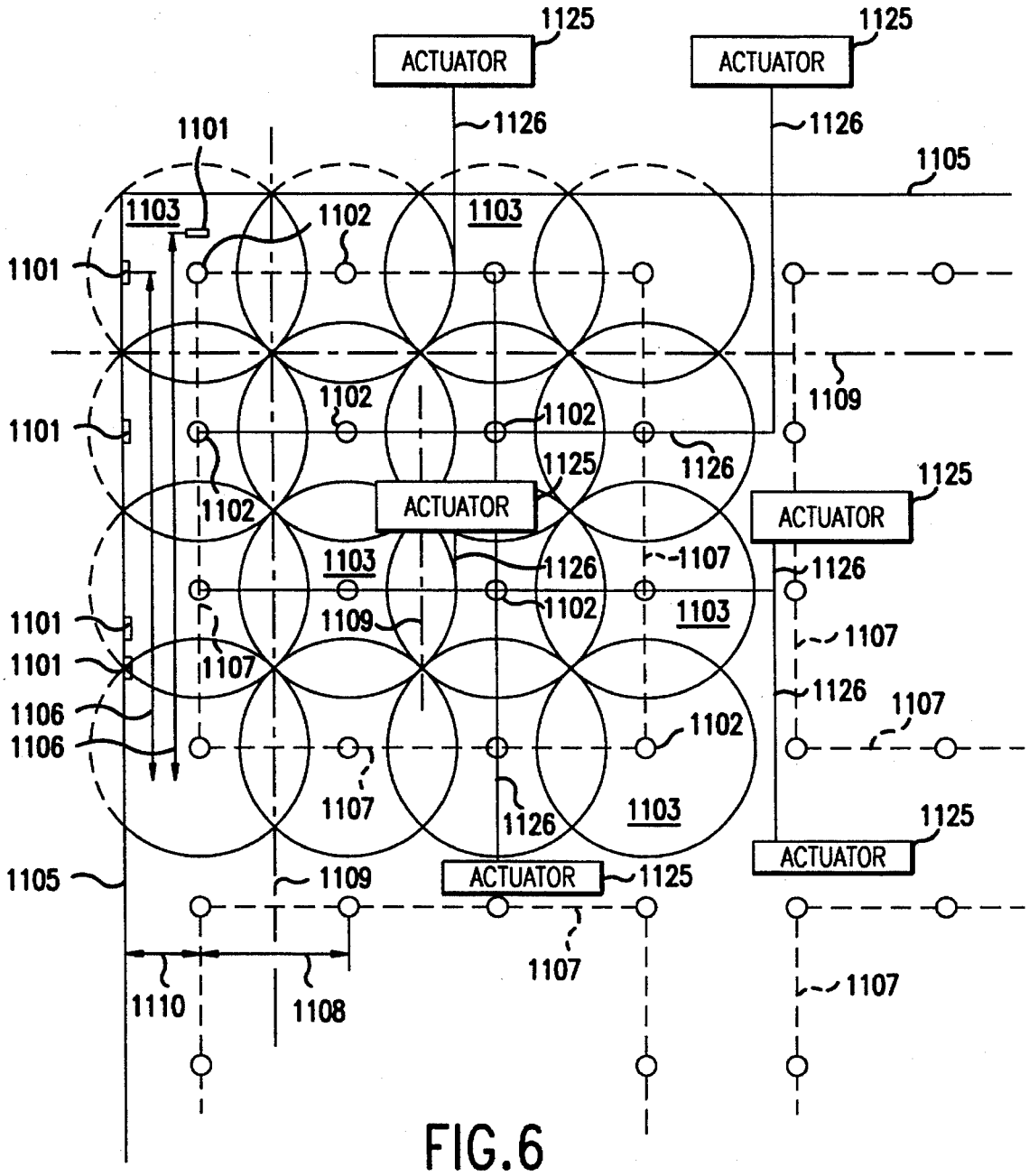
FIG. 6 illustrates a remote control system with remote-control reception ranges according to an embodiment of the present invention.

FIG. 6 illustrates an embodiment of the present invention using transmitters transmitting a message to decoders coupled to the actuators. The message is composed of a receiver address and a function command for each decoder or transmitter and the decoders control the actuators. At least one of the decoders is capable of receiving the message and sending the message to the decoder to which the message is addressed. That decoder then controls the actuators based upon the message. The transmitters work individually or in combinations with one or more of the decoders by means of suitable addressing techniques. A reception range is associated with each decoder, which range may be more or less spherical. When the reception range is projected on a plane of the decoders, the reception range is a circular area. The reception range is determined by characteristics of the transmitters and decoders, the transmitter-decoder capacity, as well as the receiving conditions such as noise. Each reception range has a unique receiver address which is not repeated within a clearance distance, which is a multiple of the reception range.

The receiver address combined with function commands constitutes the message from a transmitter to a decoder. Functions are power circuitry actions that are started individually or in groups by means of a transmitter key. Since every receiver address repeats itself only after a clearance distance, which is expressed as a multiple of reception ranges, the receiver address is only repeated when it is unlikely that two receivers with the same receiver address will receive the transmission.

The remote-control system makes it possible to programmably operate specific decoders, and thus operate assignable actuators and devices, without having to specially align transmitters and given reception ranges which vary because of factors which temporarily change the transmission characteristics. The addresses for the decoders can be easily changed when organizational or spatial changes are made. To prevent unintentional reception, the addresses are only repeated after a clearance distance corresponding to the maximum transmission length of a transmitter under extreme conditions.

The function commands for each decoder or transmitter are advantageously composed of base addresses and key addresses, which are assigned to manually operated components. In the case of commercially available devices, it is advantageous to work with sixteen base addresses and four key addresses. The functions can be programmed by means of coding switches or coding keys. In a basic transmitter with a four-channel system and sixteen functions per channel, 64 functions are possible. These can be divided into sixteen base addresses, whereby each base address in turn contains four other addresses, which can be assigned to four keys of a hand-held or wall-mounted transmitter. Another way to express this is that a transmitter includes two binary coded switches with sixteen positions.

According to another development of the present invention, the decoders feature a storage device between their receiver and their output. Functioning as an association table, this storage device assigns the received address to actuators, which are connected via a bus to the output of the decoder. This association is totally programmable. In this case, the decoders can be interconnected in a matrix-type arrangement through buses and be linked through extended buses to actuators. By means of the storage device which is used as an association table, one can easily select and change how the actuators are controlled.

According to another development of the present invention, superimposed special functions can also be achieved using the customary installed transmitters to operate the installation, and without the application of special transmitters with special channels and programs. To this end, addresses or areas for special functions are reserved in the message, preferably in the base address. Each reserved address is to be committed in the association table of any one of the decoders to control the same actuators. The decoders are connected between themselves at their outputs and to the inputs of the actuators through buses. In addition, the association table can be freely occupied with the functions. The top four base addresses are advantageously reserved for special functions. By means of the special functions, "porter transmitters" are able to be set up, and switching and control commands for specific actuators can be output from any one of the transmitters. In this manner, special functions make it possible for a transmitter to be effective into every range of the large room, whereby it is unimportant which decoder or which group of decoders pick up the transmitter.

In most commercially available units, the clearance distance is advantageously selected to equal four reception ranges in each coordinate direction. An address system for sixteen reception ranges results. With 64 functions, sixteen reception ranges result in 1024 addresses. When infrared signalling is used as a transmitting medium, a ten-bit address must be provided in the infrared message. The storage device for an association table, e.g. an EEPROM, must then contain a quantity of 64+1 storage locations, since the address of the reception range can be filed in one single address. The diagonal distance between the center points of the reception ranges is advantageously selected to be equal in size to the diameter of the reception ranges. In this manner, the distance between the center points can be adapted to the three-dimensional grid system of a building and, at the same time, ensure that the surface of a grid unit can be supplied by one single reception range. In view of existing commercial units and grid systems in buildings, the distance between the center points of the reception ranges is advantageously fixed at 12 meters. The radius of a reception range is then one half the square root of the sum of the squares of the distance.

$$r = 1/2 \sqrt{x^2 + y^2} \qquad \text{EQUATION (1)}$$

Thus, for a 12 meter distance between center points, the reception range is $$r = 1/2 \sqrt{12^2 + 12^2} = \sqrt{72} \approx 8.49 \qquad \text{EQUATION (2)}$$

With sixteen reception ranges, therefore four reception ranges for every assumed coordinate axis, a clearance distance of four times twelve meters results, thus 48 meters. Accordingly, the addressing technique can be repeated for other neighboring reception ranges.

The remote-control system according to FIG. 6 works with transmitters 1101, which work individually or in combination with one or more decoders 1102 by means of suitable addressing techniques. The decoders 1102 control actuators 1125. One should visualize these actuators 1125 as being connected through extensions and branches 1126 of a bus 1107 to the associated decoders 1102. A reception range 1103 is assigned to each decoder 1102, which reception range is approximately spherical. A circular area results when projected on a plane in which the decoders 1102 are arranged. The reception range 1103 is determined by the characteristics of the transmitters 1101 and decoders 1102, the transmitter-receiver capacity, as well as by the receiving conditions, such as reception noise. Each reception range 1103 has its own receiver address assigned to it (see FIG. 7). This receiver address 1112 combined with function commands 1113 constitutes the message 1104 from a transmitter 1101 to a decoder 1102. In the exemplified embodiment according to FIG. 6, 4×4=16 decoders 1102 with their reception ranges 1103 are arranged in the corner of an industrial shop. The decoders 1102 can be mounted on the ceiling or on a hung false ceiling. The transmitters 1101 can be designed as well-mounted transmitter units, as illustrated on the left side of the shop floor plan, or otherwise installed at a location which is directly or indirectly accessible for manual operation, as illustrated in the floor-plan view by the transmitter 1101 in the upper left of FIG. 6. The building outer walls 1105 in the shop limit the effectiveness of the reception ranges 1103 near the walls.

Under extreme conditions, a transmitter 1101 can have a very large range 1106, which is supposed to lie within the detecting range of the decoder 1102 of an address system. The decoders 1102 are advantageously arranged, so that the distance between the center points of the reception ranges 1103 (in a diagonal direction) is equal in size to the diameter of the reception ranges. When the distance 1108 between the center points of the reception ranges 1103 amounts to twelve meters, a room grid system results, whose space axes 1109 are likewise spaced apart by twelve meters. In this case, the smallest spatial unit marginated by space axes can be supplied by a reception range 1103. Here, the decoder 1102 is spaced from the sides of the grid unit by half of a distance 1108 between the center points of the reception ranges, therefore by the distance 1110. Thus in the exemplified embodiment of the present invention, the distance 1110 equals six meters. This also corresponds to the distance from the space axes 1109.

The decoders 1102 are preferably connected among themselves in a grid-type arrangement through a bus 1107, which leads through extensions and branchings 1126 to connected actuators 1125.

Figure 7:
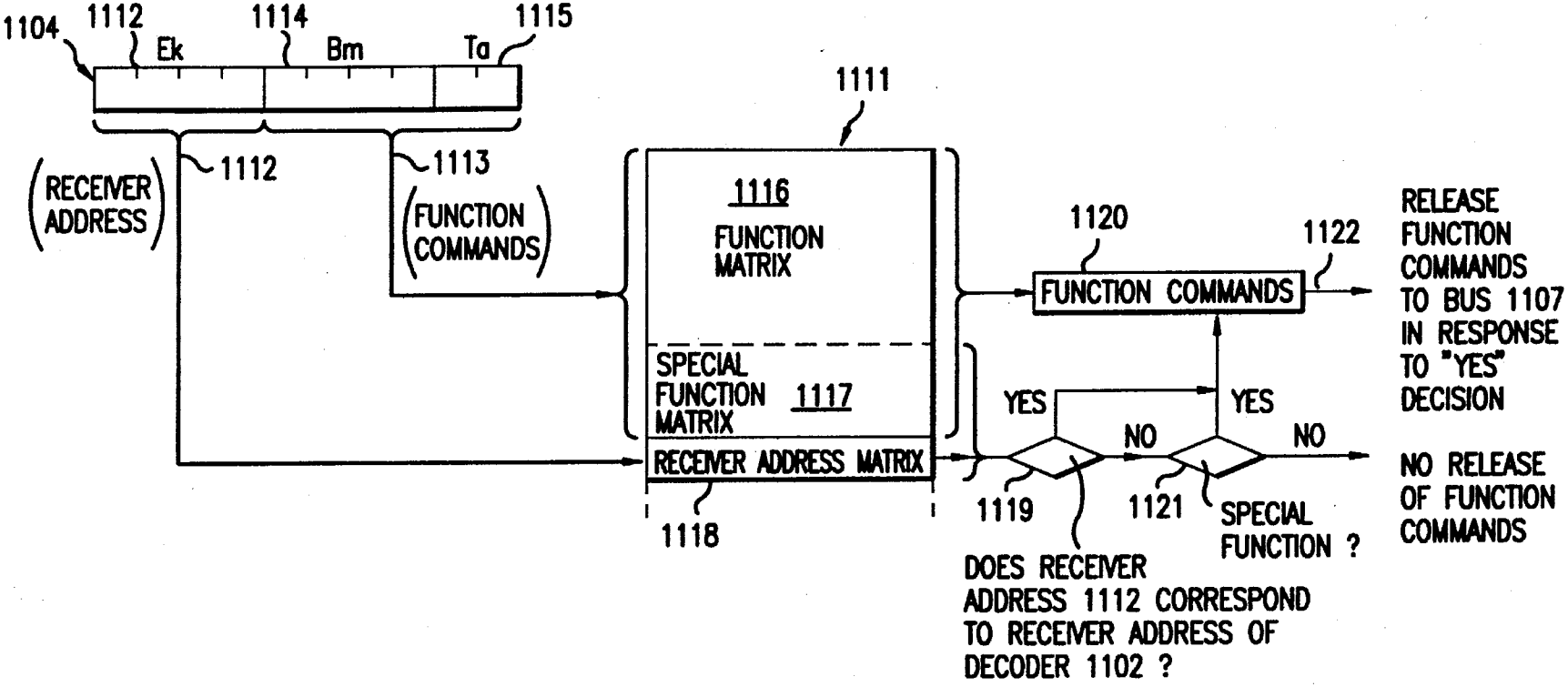
FIG. 7 illustrates the conversion of transmitted or received messages in an association table, and the retransmission of commands via a bus according to an embodiment of the present invention.

According to FIG. 7, a message 1104, which is transmitted by a transmitter 1101, is forwarded to a decoder 1102 of an address system with the association table 1111, or rather transmitted through infrared signalling. The message 1104 is composed of a receiver address 1112, designated as Ek, and of function commands 1113, which in turn are composed of base addresses 1114, designated as Bm, and of key addresses 1115, designated as Ta. In a variant which is favorable for transmitters and receivers customarily used today, the message 1104 features sixteen receiver addresses 1112 of an address system and 64 functions consisting of sixteen base addresses 1114 and four key addresses 1115. In the storage device serving as an association table 1111, the desired actuators are assigned to the functions 1113. This takes place in a function matrix 1116. Addresses of the base addresses 1114 are reserved for special functions in a special function matrix 1117. By means of the special function matrix 1117, which conforms at least with all the decoders of one address system, a specific actuator or a specific group of actuators, and thus the assigned device, can be loaded or switched by any one of the transmitters of the system. To this end, it is necessary for the decoders 1102 of one address system to all be connected to one another through buss 1122 and to the actuators 1125. A specific decoder 1102 is physically assigned to a receiver address 1112 in the receiver address matrix 1118.

The evaluation can be made effectively, in that a decision routine 1119 queries if the received receiver address 1112 conforms with the receiver address of the decoder 1102, that is to say with the corresponding reception range 1103. When this is confirmed by a "yes" decision, the transmission of the function commands 1120 to the bus line is released. When the decision routine 1119 leads to a "no" result, a subsequent decision routine 1121 tests if a special function is at hand. When the answer is "yes", the transmission of the function commands 1120 to the bus line, in this case the special functions, is released. When the answer is "no", the transmission is not released, since the receiving decoder with its reception range is not supposed to be addressed by the transmitted message.

What is claimed is:

1. A remote-control system, comprising:

a) a plurality of transmitters, each having a plurality of command keys for sending wireless messages, wherein each command key is coded with a transmitted key address;

b) a plurality of actuators;

c) a plurality of decoders, each receiving the wireless messages and having an output, whereby each of said plurality of decoders controls one or more of said plurality of actuators via said output;

d) a bus coupling the output of each decoder of said plurality of decoders to said plurality of actuators; and e) a programmable storage device disposed within each decoder, each storage device coupled to the output of the decoder within which that storage device is disposed;

wherein each said programmable storage device assigns a plurality of assigned key addresses in a user definable manner for each transmitted key address to control desired groups of said plurality of actuators via said programmable storage device with a single wireless message.

2. The remote-control system according to claim 1, wherein each of said plurality of transmitters is assigned a base address, and each said storage device further comprises an association table corresponding to each base address, which association table assigns said assigned key addresses according to said transmitted key address.

3. The remote control system according to claim 2, wherein said association table further comprises a plurality of outputs whereby said association table assigns said assigned key addresses to one of said plurality of outputs whose ordinal number corresponds to a place value of bits of the wireless message.

4. The remote-control system according to claim 2, wherein each of said plurality of transmitters further comprises a binary coding switch determining the base address for each transmitter.

5. The remote control system according to claim 4, wherein each of said plurality of decoders further comprises a pointer displaying the transmitted key address.

6. A remote-control system, comprising:

a) a transmitter for sending wireless messages, said transmitter having a plurality of keys, whereby pressing a particular key of the plurality of keys causes the transmitter to transmit a particular transmitted key address;

b) a plurality of actuators;

c) a plurality of decoders for receiving the wireless messages, each of said plurality of decoders having an output corresponding to each actuator of said plurality of actuators;

d) a bus coupling the outputs of the plurality of decoders to said plurality of actuators; and e) a programmable association table storage device disposed within each decoder, each programmable association table storage device coupled to the outputs of the decoder within which that programmable association table storage device is disposed, wherein said programmable association table storage device assigns a plurality of assigned key addresses to each transmitted key address, each assigned key address designating a particular actuator, said plurality of assigned key addresses corresponding to respective outputs of the decoder such that said transmitter remotely controls desired groups of said plurality of actuators with a single wireless message via said programmable association table storage devices and said outputs of said plurality of decoders.

7. A remote-control system, comprising:

a) a plurality of transmitters, each having a plurality of command keys for sending wireless messages, wherein each command key is coded with a transmitted key address;

b) a plurality of actuators;

c) a plurality of decoders, each receiving the wireless messages and having an output coupled to at least one of said plurality of actuators, whereby each of said plurality of decoders controls one or more of said plurality of actuators via said output; and d) a programmable storage device disposed within each decoder, each storage device coupled to the output of the decoder within which that storage device is disposed;

wherein each said programmable storage device assigns a plurality of assigned key addresses in a user definable manner for each transmitted key address to control desired groups of said plurality of actuators via said programmable storage device with a single wireless message.

8. The remote-control system according to claim 7, wherein each of said plurality of transmitters is assigned a base address, and each said storage device further comprises an association table corresponding to each base address, which association table assigns said assigned key addresses according to said transmitted key address.

9. The remote-control system according to claim 8, wherein said association table further comprises a plurality of outputs, whereby said association table assigns said assigned key addresses to one of said plurality of outputs whose ordinal number corresponds to a place value of bits of the wireless message.

10. The remote-control system according to claim 8, wherein each of said plurality of transmitters further comprises a binary coding switch determining the base address for each transmitter.

11. The remote-control system according to claim 10, wherein each of said plurality of decoders further comprises a pointer displaying the transmitted key address.

12. A remote-control system, comprising:

a) a transmitter for sending wireless messages, said transmitter having a plurality of keys, whereby pressing a particular key of the plurality of keys causes the transmitter to transmit a particular transmitted key address;

b) a plurality of actuators;

c) a plurality of decoders for receiving the wireless messages, each of said plurality of decoders having an output corresponding to and coupled to at least one of said plurality of actuators; and d) a programmable association table storage device disposed within each decoder, each programmable association table storage device coupled to the outputs of the decoder within which that programmable association table storage device is disposed, wherein said programmable association table storage device assigns a plurality of assigned key addresses to each transmitted key address, each assigned key address designated a particular actuator, said plurality of assigned key addresses corresponding to respective outputs of the decoder such that said transmitter remotely controls desired groups of said plurality of actuators with a single wireless message via said programmable association table storage devices and said outputs of said plurality of decoders.

* * * * *